US009141038B2

(12) United States Patent
Maeda et al.

(10) Patent No.: US 9,141,038 B2
(45) Date of Patent: Sep. 22, 2015

(54) IMAGE FORMING APPARATUS

(71) Applicant: CANON KABUSHIKI KAISHA, Tokyo (JP)

(72) Inventors: Masafumi Maeda, Yokohama (JP); Takeo Kawanami, Yokohama (JP); Akira Yoshimura, Suntou-gun (JP); Shinji Katagiri, Yokohama (JP); Taro Minobe, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/850,455

(22) Filed: Mar. 26, 2013

(65) Prior Publication Data

US 2013/0266336 A1 Oct. 10, 2013

(30) Foreign Application Priority Data

Apr. 4, 2012 (JP) ..... 2012-085306
Mar. 13, 2013 (JP) ..... 2013-050215

(51) Int. Cl.
*G03G 15/00* (2006.01)
*G03G 15/16* (2006.01)
*G03G 21/16* (2006.01)

(52) U.S. Cl.
CPC ..... *G03G 15/1605* (2013.01); *G03G 21/168* (2013.01); *G03G 21/1652* (2013.01)

(58) Field of Classification Search
CPC ..... G03G 15/1605; G03G 21/1652; G03G 21/168
USPC ..... 399/66, 90, 297, 302, 308
See application file for complete search history.

(56) References Cited

U.S. PATENT DOCUMENTS 5,809,387 A * 9/1998 Takeuchi et al. ..... 399/302
6,522,845 B2 * 2/2003 Sameshima ..... 399/88

(Continued)

FOREIGN PATENT DOCUMENTS

CN 101713941 A 5/2010
JP 2001-175092 A 6/2001

(Continued)

OTHER PUBLICATIONS

Chinese Office Action dated Mar. 24, 2015, in related Chinese Patent Application No. 20131016359.0 (with English translation).
Korean Office Action dated Jul. 1, 2015, in related Korean Patent Application No. 10-2013-0036132.

*Primary Examiner* — Francis Gray
(74) *Attorney, Agent, or Firm* — Fitzpatrick, Cella, Harper & Scinto

(57) ABSTRACT

An image forming apparatus includes an apparatus main body, an image bearing member capable of bearing a toner image, a current supply member, and an intermediate transfer unit which is removably mounted to the apparatus main body. When the intermediate transfer unit is attached to the apparatus main body, the intermediate transfer unit includes an endless belt whose outer peripheral surface is configured to contact the current supply member, onto which the toner image is transferred from the image bearing member by current supplied from the current supply member, a contact member configured to contact an inner peripheral surface of the endless belt at a position opposed to the image bearing member through the endless belt, an opposing member configured to contact the inner peripheral surface of the endless belt at a position opposed to the current supply member through the endless belt, and a voltage maintaining element which is connected to the opposing member and the contact member.

25 Claims, 14 Drawing Sheets

(56) References Cited

U.S. PATENT DOCUMENTS

| | | | | |
|---|---|---|---|---|
| 8,238,790 | B2 | 8/2012 | Furuya et al. | |
| 2002/0048466 | A1 | 4/2002 | Sameshima | |
| 2009/0067895 | A1* | 3/2009 | Tominaga | 399/308 |
| 2009/0136270 | A1* | 5/2009 | Yamada | 399/308 |
| 2010/0080625 | A1 | 4/2010 | Furuya et al. | |
| 2010/0232820 | A1* | 9/2010 | Usami et al. | 399/66 |
| 2011/0135347 | A1* | 6/2011 | Takishita | 399/297 |
| 2013/0259506 | A1* | 10/2013 | Katagiri et al. | 399/66 |
| 2013/0259543 | A1* | 10/2013 | Katagiri et al. | 399/302 |

FOREIGN PATENT DOCUMENTS

| | | | |
|---|---|---|---|
| JP | 2003-195697 | A | 7/2003 |
| JP | 2006-151697 | A | 6/2006 |
| JP | 2010-85593 | A | 4/2010 |
| KR | 10-2003-0021516 | A | 3/2003 |
| KR | 10-2006-0044293 | A | 5/2006 |

* cited by examiner

IMAGE FORMING APPARATUS

BACKGROUND OF THE INVENTION

1. Field of the Invention

The present invention relates to an image forming apparatus, such as a copying machine and a printer, in which a toner image formed on an image bearing member is transferred onto an intermediate transfer belt, and is subsequently transferred to a recording material.

2. Description of the Related Art

Conventionally, as an image forming apparatus such as a copying machine and a laser beam printer, a configuration which includes an intermediate transfer belt as an intermediate transfer member is known. In this image forming apparatus, toner images formed on image bearing members of respective image forming portions are transferred onto an intermediate transfer belt by a primary transfer process so as to be superposed, and are subsequently transferred collectively from the intermediate transfer belt onto a recording material by a secondary transfer process so as to form a color image (multiple images).

The image forming portions of respective colors include photosensitive drums as the image bearing members, respectively. Moreover, each image forming portion includes, in addition to the above-mentioned photosensitive drum, a charging member which charges the photosensitive drum, and a developing unit which develops the toner image on the photosensitive drum. The charging member of each image forming portion comes into contact with the photosensitive drum under a predetermined contact pressure, so as to uniformly charge the surface of the photosensitive drum with a predetermined polarity and potential by a charging voltage which is applied from a voltage power supply (not shown) for charging.

The toner image developed on the photosensitive drum of each image forming portion is primarily transferred onto the intermediate transfer belt by a primary transfer member which is opposed to the photosensitive drum across the intermediate transfer belt. A power supply for transfer (power circuit), which is dedicated to the primary transfer, is connected to each primary transfer member. The toner image primarily transferred onto the intermediate transfer belt is secondarily transferred onto the recording material by a secondary transfer member. A power supply for transfer (power circuit), which is dedicated to the secondary transfer, is connected to the secondary transfer member.

For example, Japanese Patent Application Laid-Open No. 2003-195697 discloses that four power supplies for transfer used for the primary transfer are required for the primary transfer for the respective colors, and further, a single power supply for transfer used for the secondary transfer is required for the secondary transfer. These power supplies for transfer used for the primary transfer are required to apply a voltage, which is set so as to obtain an optimum ability of primary transfer, to the primary transfer members. When a large number of power supplies for transfer used for the primary transfer are required, a large number of supply portions of high voltage output are disposed on a high voltage substrate, so that the high voltage substrate is inevitably enlarged.

Moreover, in a configuration in which an intermediate transfer unit can be removed from an apparatus main body of an image forming apparatus so as to be exchanged, when the number of the power supplies for transfer dedicated to the primary transfer is large, a large number of electric contacts are required between the intermediate transfer unit and the apparatus main body. Accordingly, there are concerns that the apparatus may be complicated, and the cost may be increased due to the increase of the number of parts.

SUMMARY OF THE INVENTION

A purpose of the present invention is to decrease the number of electric contacts between an intermediate transfer unit and an apparatus main body so that an apparatus can be downsized, and the cost can be lowered.

Another purpose of the present invention is to provide an image forming apparatus, including: an apparatus main body; an image bearing member which bears a toner image; an intermediate transfer unit which is removably mounted to the apparatus main body, the intermediate transfer unit including an endless belt to which the toner image is primarily transferred from the image bearing member, the endless belt being movable and electrically conductive, and a contact member which comes into contact with the endless belt on a side on which a primary transfer surface of the endless belt is formed, the toner image from the image bearing member being primarily transferred onto the primary transfer surface; and a current supply member which comes into contact with the endless belt and supplies a current to the endless belt. The intermediate transfer unit includes an opposing member which is opposed to the current supply member across the endless belt, and a voltage maintaining element which is connected to the opposing member and the contact member.

Still another purpose of the present invention is to provide an image forming apparatus, including: an apparatus main body; an image bearing member which bears a toner image; an intermediate transfer unit which is removably mounted to the apparatus main body, the intermediate transfer unit including an endless belt to which the toner image is primarily transferred from the image bearing member, the endless belt being movable and electrically conductive, and multiple tensioning members which tension the endless belt and form a primary transfer surface of the endless belt to which the toner image from the image bearing member is primarily transferred; and a current supply member which comes into contact with an outer circumferential surface of the endless belt and supplies a current to the endless belt. The intermediate transfer unit further includes a voltage maintaining element which is connected to the multiple tensioning members.

Further features of the present invention will become apparent from the following description of exemplary embodiments with reference to the attached drawings.

DESCRIPTION OF THE EMBODIMENTS

Exemplary embodiments of the present invention are illustratively described in detail hereinafter with reference to the drawings. However, sizes, materials, and shapes of components described in the following embodiments, and their relative positions, are subject to appropriate change in accordance with a configuration and various conditions of an apparatus to which the present invention is applied. Accordingly, as long as there is no specific description, it is not intended to limit the scope of the present invention only to those exemplary embodiments.

(First Embodiment)

Figure 1:
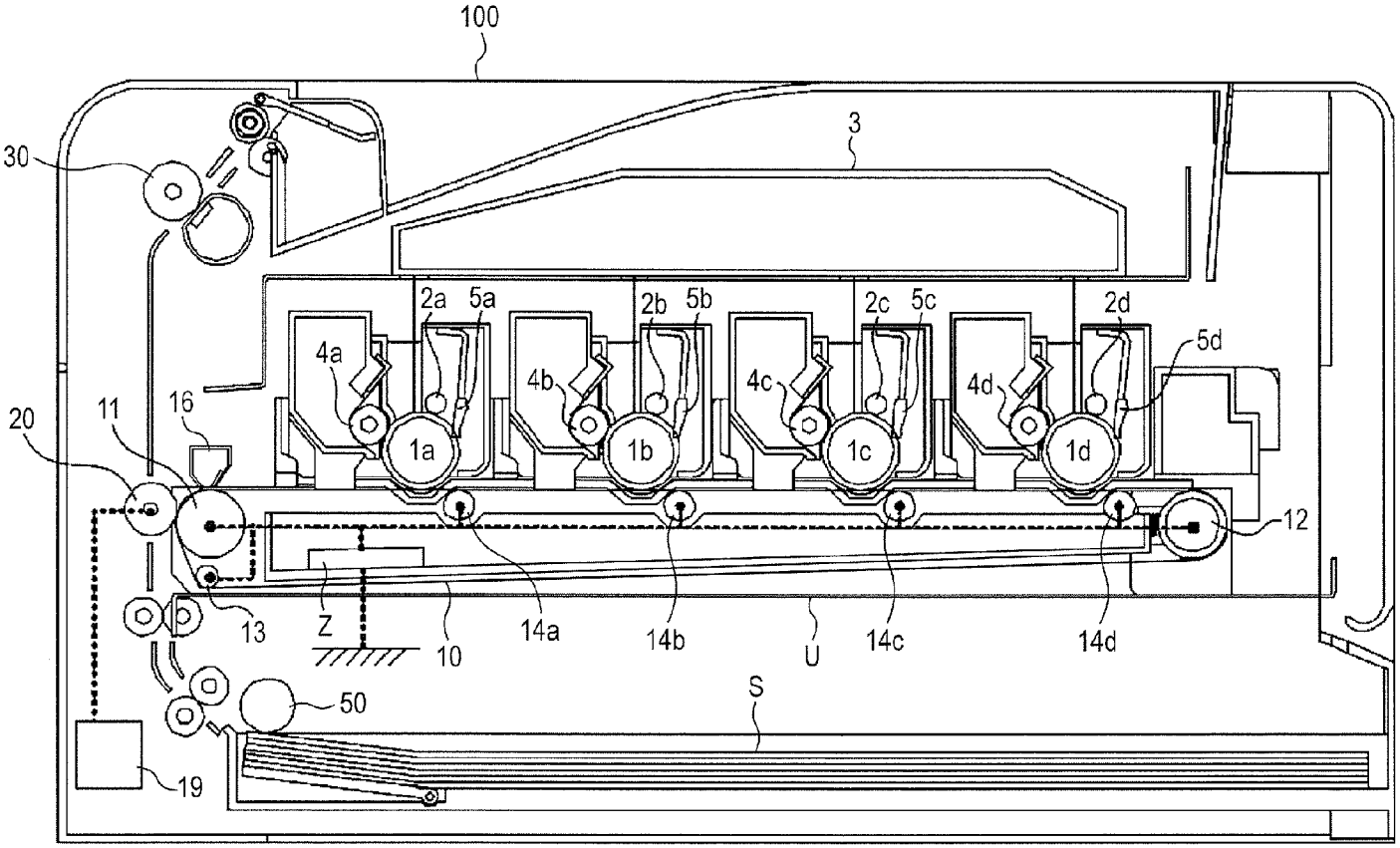
FIG. 1 is a schematic cross-sectional view of an image forming apparatus according to a first embodiment of the present invention.

In this embodiment, as an image forming apparatus 100, a color image forming apparatus of an intermediate transfer belt type is exemplified. Using FIG. 1, a configuration of the image forming apparatus according to this embodiment is described.

The image forming apparatus 100 includes drum shaped electrophotographic photosensitive members (hereinafter referred to as "photosensitive drum") 1*a*, 1*b*, 1*c*, and 1*d*. The photosensitive drums 1*a*, 1*b*, 1*c*, and 1*d* are respectively image bearing members which bear toner images, and are driven to rotate at a predetermined circumferential speed (process speed).

The photosensitive drums 1*a*, 1*b*, 1*c*, and 1*d* are, during this rotation process, processed to be uniformly charged with a predetermined polarity and potential by charging rollers 2*a*, 2*b*, 2*c*, and 2*d* as charging members, respectively, and are subsequently exposed by an exposure unit 3. With this, electrostatic latent images corresponding to respective color component images of a desired color image are formed. Next, the electrostatic latent images formed on the respective photosensitive drums 1*a*, 1*b*, 1*c*, and 1*d* are developed at development positions by developing units 4*a*, 4*b*, 4*c*, and 4*d* of respective colors so as to be visualized as toner images.

An intermediate transfer belt 10 is an endless belt provided with an electrical conductivity, and is tensioned by a drive roller 11, a tension roller 12, and an auxiliary roller 13 which are multiple tensioning members. The intermediate transfer belt 10 can move at a circumferential speed which is substantially the same as that of each of the photosensitive drums 1*a*, 1*b*, 1*c*, and 1*d* when moving in the same direction as each of the photosensitive drums 1*a*, 1*b*, 1*c*, and 1*d* at an opposing portion (abutting portion) which abuts on the photosensitive drum 1. The toner images formed on the photosensitive drums 1*a*, 1*b*, 1*c*, and 1*d* are each transferred onto the intermediate transfer belt 10 so as to be superposed in the process of passing through a primary transfer portion which is a first contact station between the photosensitive drums 1*a*, 1*b*, 1*c*, and 1*d* and the intermediate transfer belt 10 (primary transfer). Note that, at positions corresponding to the respective photosensitive drums 1*a*, 1*b*, 1*c*, and 1*d* across the intermediate transfer belt 10, contact rollers 14*a*, 14*b*, 14*c*, and 14*d*, which are multiple contact members, are disposed across the intermediate transfer belt 10, respectively. The contact members are each a member which comes into contact with the intermediate transfer belt 10 on the side on which a primary transfer surface of the intermediate transfer belt 10, to which the toner images are primarily transferred from the photosensitive drums 1*a*, 1*b*, 1*c*, and 1*d*, is formed.

In this embodiment, a primary transfer potential is formed at the respective primary transfer portions of the intermediate transfer belt 10 by supplying a current from a current supply member to the intermediate transfer belt 10, and the toner images are primarily transferred by potential differences with respect to corresponding photosensitive drums.

Primary transfer residual toner, which remains on the surfaces of the photosensitive drums 1*a*, 1*b*, 1*c*, and 1*d*, is cleaned by cleaning devices 5*a*, 5*b*, 5*c*, and 5*d* as cleaning units so as to be removed. After that, the photosensitive drums 1 are subjected to image forming processes following the charging.

Note that, in this embodiment, the photosensitive drum 1 as the image bearing member, the charging roller 2, the developing unit 4, and the cleaning device 5 as process units which act on the photosensitive drum 1, are integrated together as a process cartridge, which is removably mounted to a main body of the image forming apparatus 100.

The toner images of four colors, which have been primarily transferred onto the intermediate transfer belt 10, are collectively transferred to a surface of a sheet S as a recording material which has been fed by a feeding unit 50 in the process of passing through a secondary transfer station which is a second contact portion between the intermediate transfer belt 10 and a secondary transfer roller 20 as a secondary transfer member (secondary transfer). Note that, when performing the secondary transfer, the secondary transfer roller 20 is applied with a voltage by a power supply 19 for transfer. The drive roller 11 also functions as a secondary transfer opposing member which is opposed to the secondary transfer roller 20 across the intermediate transfer belt.

Note that, the secondary transfer roller 20 of this embodiment is a current supply member which is applied with a voltage from the power supply 19 for transfer, which is a common voltage power supply for performing the primary transfer and the secondary transfer, and supplies a current in the circumferential direction of the intermediate transfer belt 10.

On the outer side of the intermediate transfer belt 10, a belt cleaning unit 16, which removes and recovers transfer residual toner remaining on the surface of the intermediate transfer belt 10, is disposed.

After that, the sheet S, to which the toner images of four colors have been transferred, is introduced into a fixing unit 30, and is heated and pressurized at the fixing unit 30 so that the toner of four colors is melted and mixed so as to be fixed to the sheet S. By the above-mentioned operations, a print image of full color is formed.

Figure 2:
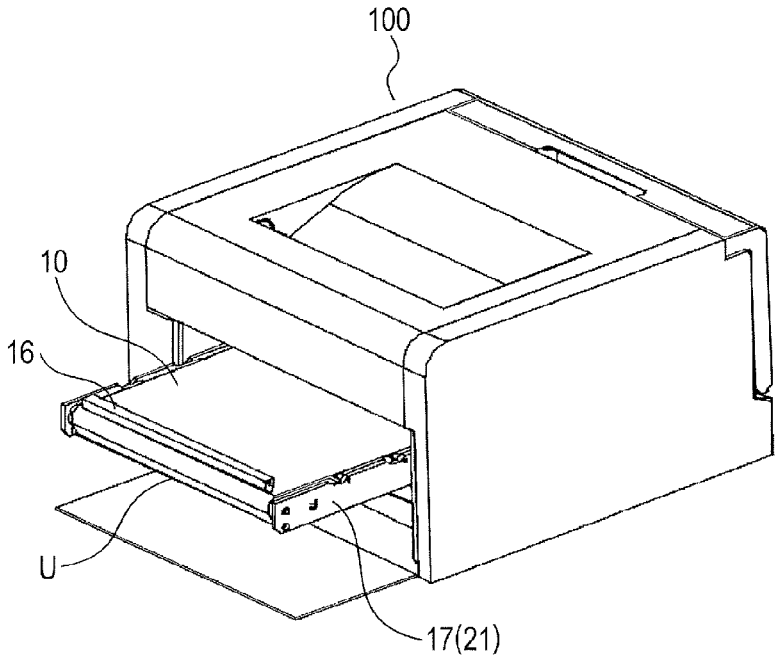
FIG. 2 is a perspective view of the image forming apparatus according to the first embodiment to which an intermediate transfer unit is removably mounted.

Moreover, as illustrated in FIG. 2, the intermediate transfer belt 10 is integrated as an intermediate transfer unit U together with the drive roller 11, the tension roller 12, and the auxiliary roller 13 which are the multiple tensioning members, and the contact rollers 14*a*, 14*b*, 14*c*, and 14*d* as the contact members. This intermediate transfer unit U is removably mounted to the apparatus main body of the image forming apparatus 100.

Figure 3:
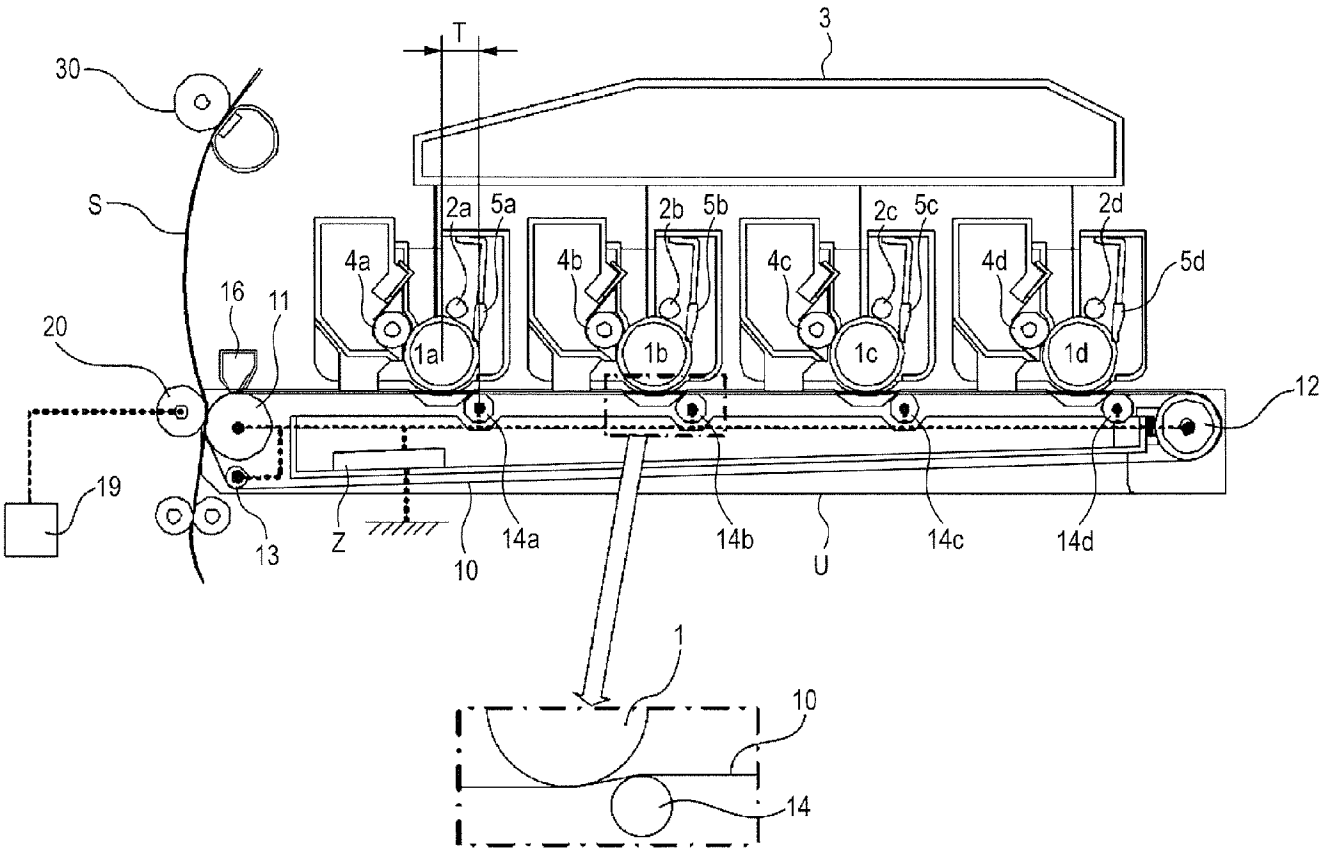
FIG. 3 is a schematic cross-sectional view of the intermediate transfer unit of the first embodiment.

Next, with reference to FIG. 3, a current path concerning the transfer according to this embodiment is described. FIG. 3 is a schematic cross-sectional view of the image forming apparatus according to this embodiment.

As illustrated in FIG. 3, the contact rollers 14*a*, 14*b*, 14*c*, and 14*d*, which are the contact members, are disposed between the drive roller 11 and the tension roller 12, which tension the belt surface of the intermediate transfer belt 10 which comes into contact with the photosensitive drum, among the multiple tensioning members. In this embodiment, as mentioned above, the contact rollers 14*a*, 14*b*, 14*c*, and 14*d* are disposed so as to come into contact with the inner surface of the intermediate transfer belt 10 correspondingly to the respective photosensitive drums 1*a*, 1*b*, 1*c*, and 1*d*. In a case of a configuration in which the contact members are brought into contact with the outer surface of the intermediate transfer belt 10, the contact members may be brought into contact with a longitudinal end portion of the belt outer surface of the intermediate transfer belt 10.

The toner images on the photosensitive drums 1*a*, 1*b*, 1*c*, and 1*d* are primarily transferred onto the intermediate transfer belt 10 at the primary transfer portion which is the first contact station formed by the photosensitive drums 1*a*, 1*b*, 1*c*, and 1*d* and the intermediate transfer belt 10, respectively. The contact rollers 14*a*, 14*b*, 14*c*, and 14*d* can be used as members for widely stabilizing the contact width of the primary transfer portion which is the first contact station. Note that, in this embodiment, the contact rollers 14*a*, 14*b*, 14*c*, and 14*d* as the contact members are not configured to be connected to the voltage power supply for primary transfer.

In this embodiment, the contact rollers 14*a*, 14*b*, 14*c*, and 14*d* are formed of rigid bodies, such as metal rollers. The contact rollers 14*a*, 14*b*, 14*c*, and 14*d* are not configured to directly press the intermediate transfer belt 10 against the opposite photosensitive drums 1*a*, 1*b*, 1*c*, and 1*d*. Specifically, the contact rollers 14*a*, 14*b*, 14*c*, and 14*d* are configured so as not to directly press the intermediate transfer belt 10 by shifting the positions thereof in the moving direction of the intermediate transfer belt 10 with respect to the opposite photosensitive drums 1*a*, 1*b*, 1*c*, and 1*d*. As described above, the position is shifted in the moving direction of the intermediate transfer belt 10 from the primary transfer portion which is formed of the photosensitive drum 1 and the intermediate transfer belt 10, and this shifting is defined as offset (T). The contact rollers 14*a*, 14*b*, 14*c*, and 14*d* are fixed at positions at which they protrude slightly into the upper side (photosensitive drum side) with respect to the belt surface of the intermediate transfer belt 10 which is tensioned by the drive roller 11 and the tension roller 12. With this, as illustrated in the enlarged view of FIG. 3, the intermediate transfer belt 10 can be pressed on each of the photosensitive drums 1*a*, 1*b*, 1*c*, and 1*d* so that the photosensitive drums 1*a*, 1*b*, 1*c*, and 1*d* and the intermediate transfer belt 10 can be more surely brought into contact with each other. By adopting such a configuration, the surfaces of the photosensitive drums 1*a*, 1*b*, 1*c*, and 1*d* are not damaged, even when the contact rollers 14*a*, 14*b*, 14*c*, and 14*d* are rigid members, such as metal rollers.

As illustrated in FIG. 3, the tensioning members (drive roller 11, tension roller 12, and auxiliary roller 13) and the contact rollers 14*a*, 14*b*, 14*c*, and 14*d* are connected to a voltage maintaining element Z. The voltage maintaining element Z is disposed at the intermediate transfer unit U, and is electrically grounded via a contact between the intermediate transfer unit U and the apparatus main body.

The respective members, to which the voltage maintaining element Z is connected, are maintained at a predetermined potential or higher by the current which flows from the secondary transfer roller 20 as the current supply member to the voltage maintaining element Z via the intermediate transfer belt 10. The predetermined potential is a potential which is set so that the primary transfer potential, which can achieve a desired transfer efficiency, can be maintained at the respective primary transfer portions.

In this embodiment, as the voltage maintaining element Z, a Zener diode, which is a constant voltage element, is used. A Zener voltage is hereinafter defined as a voltage which is applied between an anode and a cathode when a voltage is applied to the Zener diode in a reverse direction. Note that, a varistor may be used as the constant voltage element.

When the Zener diode is used as the voltage maintaining element Z, an absolute value of the Zener voltage of the Zener diode only needs to be set to a predetermined potential or higher. In this embodiment, the predetermined potential is set to 150 V, and the Zener voltage is set to 300 V as the voltage for maintaining the predetermined potential or higher.

Figure 4:
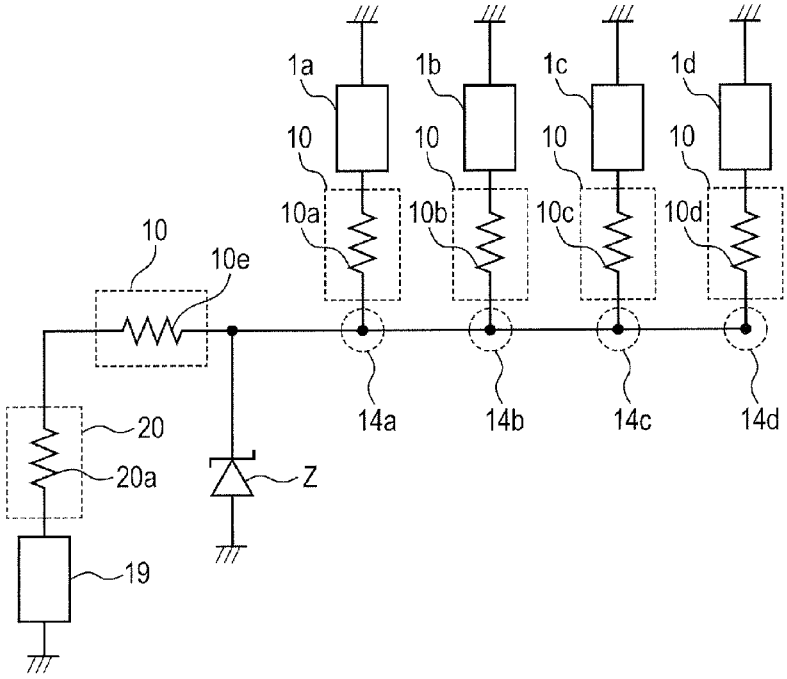
FIG. 4 is an explanatory diagram for illustrating a current flowing in the intermediate transfer unit and potentials of respective portions.

FIG. 4 is an explanatory diagram for illustrating the flowing current and the potential of the respective portions when applying the voltage from the power supply 19 for transfer to the secondary transfer roller 20.

When the voltage is applied from the power supply for transfer to the secondary transfer roller 20, a current flows from the secondary transfer roller 20 to the grounded Zener diode Z via the intermediate transfer belt 10 and the drive roller 11. At this time, the Zener diode Z allows the current to flow from the cathode side to the anode side so as to create a state in which voltage is applied in the reverse direction. Because the anode side of the Zener diode Z is grounded, the cathode side of the Zener diode Z is maintained at the Zener voltage. Accordingly, the drive roller 11, which is connected to the cathode side of the Zener diode Z, is maintained at 300 V.

Moreover, the contact rollers 14*a*, 14*b*, 14*c*, and 14*d* are connected to the Zener diode Z, and hence the contact rollers 14*a*, 14*b*, 14*c*, and 14*d* can be maintained at 300 V similarly to the drive roller 11. In this manner, by applying the voltage from the power supply 19 for transfer to the secondary transfer roller 20, the current flows through the Zener diode Z via the secondary transfer roller 20, the intermediate transfer belt 10, and the drive roller 11. When the current of a predetermined amount or more flows, the cathode side of the Zener diode Z is maintained at the Zener voltage so that the contact rollers 14*a*, 14*b*, 14*c*, and 14*d* are also maintained at a predetermined potential or higher.

Namely, the potential can be created at the contact rollers 14*a*, 14*b*, 14*c*, and 14*d* only by applying the voltage from the power supply 19 for transfer to the secondary transfer roller 20 without applying the voltage from the power supply for primary transfer to the contact rollers 14*a*, 14*b*, 14*c*, and 14*d*.

In this embodiment, because the contact rollers 14*a*, 14*b*, 14*c*, and 14*d* are maintained at the predetermined potential or higher, fluctuations in potential at the respective primary transfer portions can be suppressed so that an excellent ability of primary transfer can be ensured.

In this embodiment, because the drive roller 11, which is opposed to the secondary transfer roller 20, is connected to the Zener diode Z, even when the primary transfer and the secondary transfer are simultaneously performed, the fluctuations in potential at the respective primary transfer portions can be suppressed. This is because, in the case where the current supplied from the secondary transfer roller 20 changes for maintaining the ability of secondary transfer, the excessively flowing current flows to the ground side via the Zener diode Z so that the potential of the primary transfer portion is hardly affected therefrom.

Next, with reference to FIGS. 5A to 5E, configurations of respective members of the intermediate transfer unit U and the voltage maintaining element Z are described.

Figure 5A:
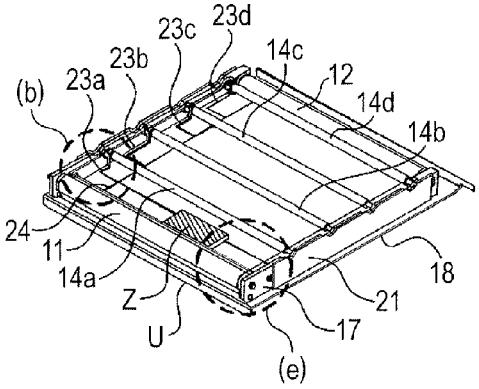
FIGS. 5A, 5B, 5C, 5D, and 5E are perspective views of the intermediate transfer unit according to the first embodiment.
Figure 5B:
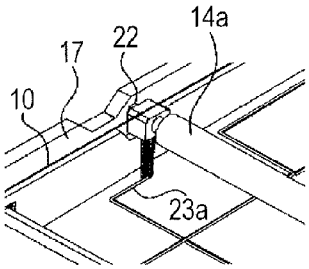
Figure 5C:
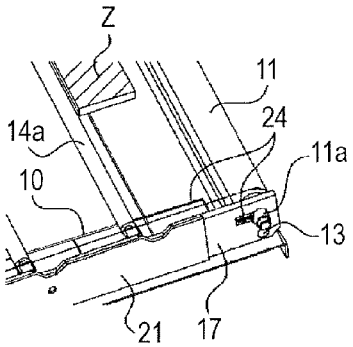
Figure 5D:
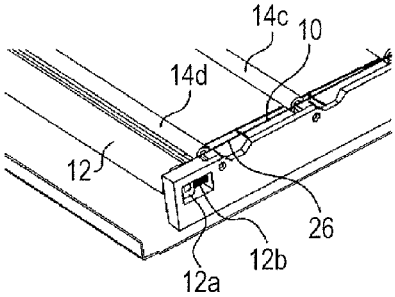
Figure 5E:
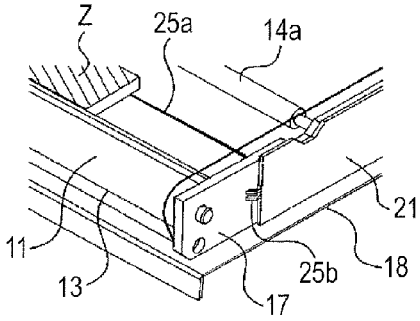

FIG. 5A is a perspective view for illustrating a relationship between the intermediate transfer unit U of this embodiment and a frame 21 which is a part of the apparatus main body. FIG. 5B is a perspective view illustrating a connection configuration of the contact rollers 14*a*, 14*b*, 14*c*, and 14*d*. FIGS. 5C and 5D are perspective views illustrating connection configurations of the tensioning members (drive roller 11, tension roller 12, and auxiliary roller 13). FIG. 5E is a perspective view illustrating an electric contact from the voltage maintaining element to the image forming apparatus main body. In FIGS. 5A to 5E, for convenience of description, the intermediate transfer belt 10 is illustrated as a transparent member.

As illustrated in FIG. 5A, the intermediate transfer unit U includes the multiple tensioning members (drive roller 11, tension roller 12, and auxiliary roller 13) and the contact rollers 14*a*, 14*b*, 14*c*, and 14*d* as the contact members, and further, inside the unit U, the Zener diode Z as the voltage maintaining element. The intermediate transfer unit U is supported by the frame 21(main body frame 21) which is a part of the apparatus main body 100, and includes an electric contact between the frame 21 and the intermediate transfer unit U. The Zener diode Z is electrically connected to contact springs 23*a*, 23*b*, 23*c*, and 23*d*, a drive roller contact spring 24, a contact spring 25*a*, and a tension roller contact spring 26.

The frame 21 is formed as a side surface frame in the apparatus main body 100, and functions as a positioning member for positioning the process cartridge including the photosensitive drums 1*a*, 1*b*, 1*c*, and 1*d* to the apparatus main body.

As illustrated in FIG. 5B, the contact roller 14*a* is fixed on a side surface frame 17 of the intermediate transfer unit. A contact roller bearing 22 made of an electrically conductive material is disposed on a contact roller shaft, and is pressed by the contact spring 23*a*. With this, the contact roller 14*a* is electrically connected to the Zener diode Z. Accordingly, in a state in which the Zener diode Z maintains the Zener voltage, because the contact roller 14*a* is electrically connected to the Zener diode Z via the contact spring 23*a*, a predetermined potential or higher can be maintained.

The respective contact rollers 14*a*, 14*b*, 14*c*, and 14*d* have similar configurations, and can be electrically connected to the Zener diode Z by being pressed by the respective contact springs 23*a*, 23*b*, 23*c*, and 23*d*.

As illustrated in FIG. 5C, the drive roller 11 has a drive roller shaft to which a drive roller bearing 11*a* made of an electrically conductive material is disposed, and is pressed by the drive roller contact spring 24 which is connected to the Zener diode Z. The drive roller 11 can be electrically connected to the Zener diode Z by being pressed by the drive roller contact spring 24. Accordingly, in a state in which the Zener diode Z maintains the Zener voltage, the drive roller 11 can maintain a predetermined electrical potential or higher because the drive roller 11 is electrically connected to the Zener diode Z via the drive roller contact spring 24.

Moreover, although it is not shown, similarly, the auxiliary roller 13 is maintained at a predetermined electrical potential or higher by using an auxiliary roller bearing made of an electrically conductive material and an auxiliary roller contact spring.

As illustrated in FIG. 5D, the tension roller 12 is electrically connected to the Zener diode Z via a tension roller bearing 12*a*, a tension spring 12*b* for applying tension to the intermediate transfer belt 10, and the tension roller contact spring 26. Accordingly, in a state in which the Zener diode Z maintains the Zener voltage, the tension roller 12 can be maintained at a predetermined potential or higher because the tension roller 12 is electrically connected to the Zener diode Z via the tension roller contact spring 26.

FIG. 5E is an enlarged view of a part of FIG. 5A for illustrating an electric contact between the intermediate transfer unit U and the frame 21. The intermediate transfer unit U includes a contact spring 25*b* as a contact portion which comes into contact with the frame 21. The contact spring 25*b* is connected to the Zener diode Z via the contact spring 25*a*. The frame 21 is connected to the ground portion which is grounded. Accordingly, the Zener diode is grounded via the contact spring 25*b* which is the contact portion and the frame 21.

Figure 6:
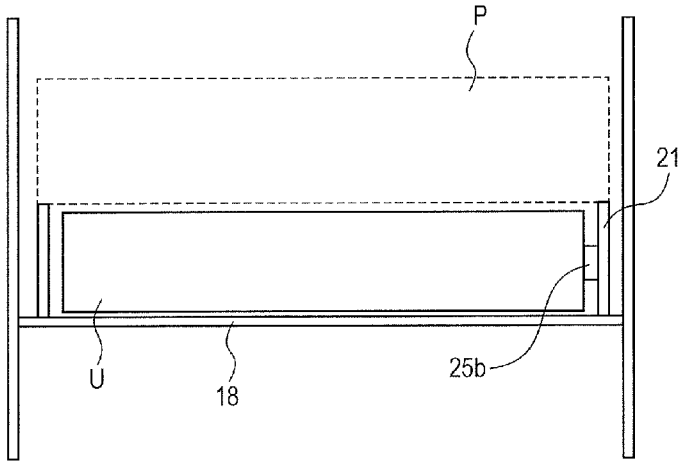
FIG. 6 is a schematic cross-sectional view for illustrating a positional relationship of a frame and the intermediate transfer unit according to the first embodiment.

FIG. 6 is a schematic cross-sectional view for illustrating the frame 21 provided to the apparatus main body 100. In the cross-sectional view, the apparatus main body 100 is seen from the left side of FIG. 2. The frame 21 is a frame which is configured so as to support the intermediate transfer unit U together with a bottom surface frame 18 on the lower side of a process cartridge P. The contact spring 25*b* is brought into contact with a part of this frame 21 so that the contact spring 25*b* can be grounded via the frame 21 only by mounting the intermediate transfer unit U on the apparatus main body 100.

Figure 7:
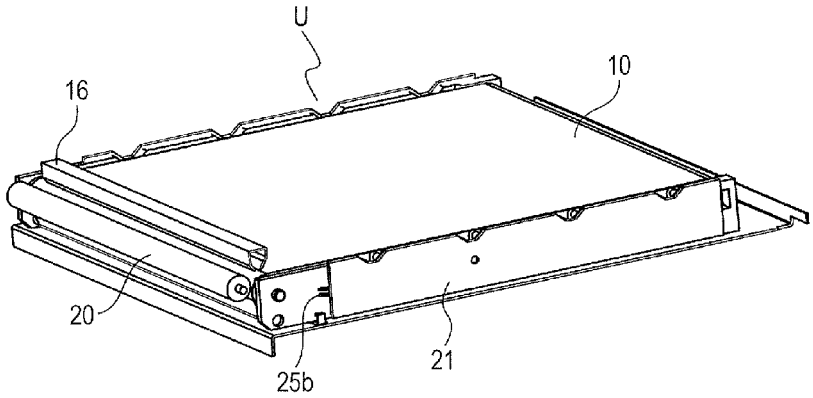
FIG. 7 is a perspective view for illustrating a secondary transfer station of the image forming apparatus according to the first embodiment.

As described with reference to FIG. 4, in this embodiment, the potential is created in the Zener diode Z and the contact rollers 14*a*, 14*b*, 14*c*, and 14*d* by the current which is supplied from the secondary transfer roller 20. FIG. 7 is a perspective view for illustrating the intermediate transfer unit U and the secondary transfer station of the secondary transfer roller 20. As described with reference to FIG. 7, the secondary transfer roller 20, which is the current supply member, comes into contact with the intermediate transfer belt 10 over a predetermined range in the width direction which is the direction orthogonal to the moving direction of the intermediate transfer belt 10. Therefore, even when some positional shift occurs between the intermediate transfer unit U and the frame 21, the current can be surely supplied from the secondary transfer roller 20 to the intermediate transfer belt 10.

Figure 8:
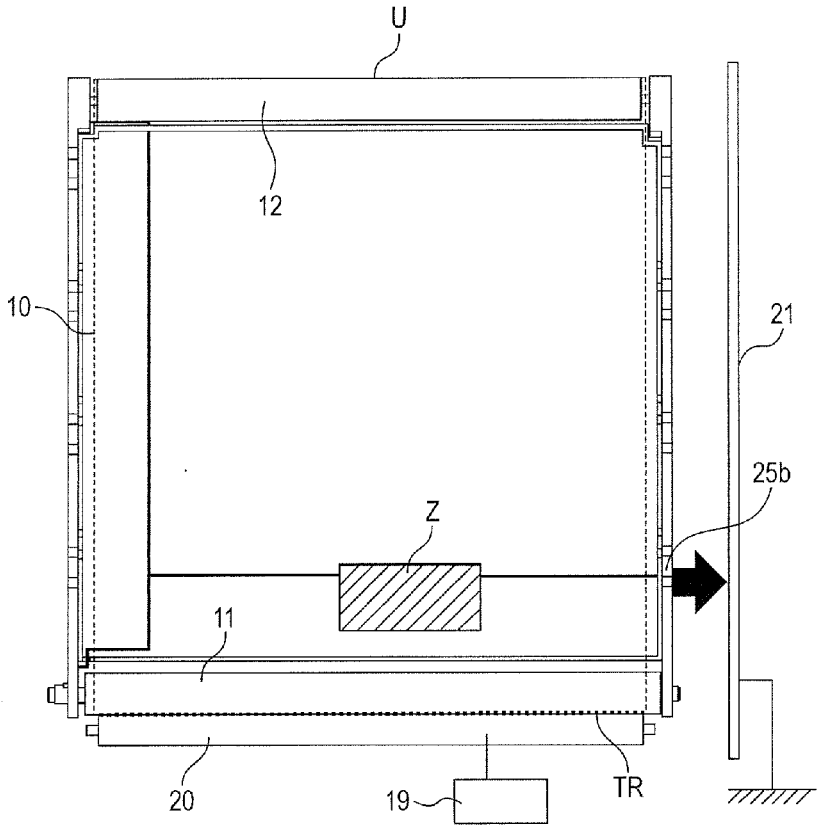
FIG. 8 is a schematic top view for illustrating a positional relationship of the frame and the intermediate transfer unit according to the first embodiment.

FIG. 8 is a top view for illustrating a contact position relationship between the intermediate transfer unit U and the frame 21. Description regarding the contact rollers 14*a*, 14*b*, 14*c*, and 14*d* is omitted. As described with reference to FIG. 8, the intermediate transfer unit U of this embodiment is not configured to be applied with the voltage from the voltage power supply which is dedicated to the primary transfer, and hence, does not include a contact portion for supply which is dedicated to the primary transfer. The current for performing the primary transfer is supplied from the secondary transfer station which is illustrated by a dotted line TR in FIG. 8. Accordingly, there is no need for providing a high voltage substrate on the frame 21 side so as to supply a current from a voltage power supply dedicated to the primary transfer which is disposed on the high voltage substrate. Accordingly, in this embodiment, the number of electric contacts can be decreased.

Figure 9A:
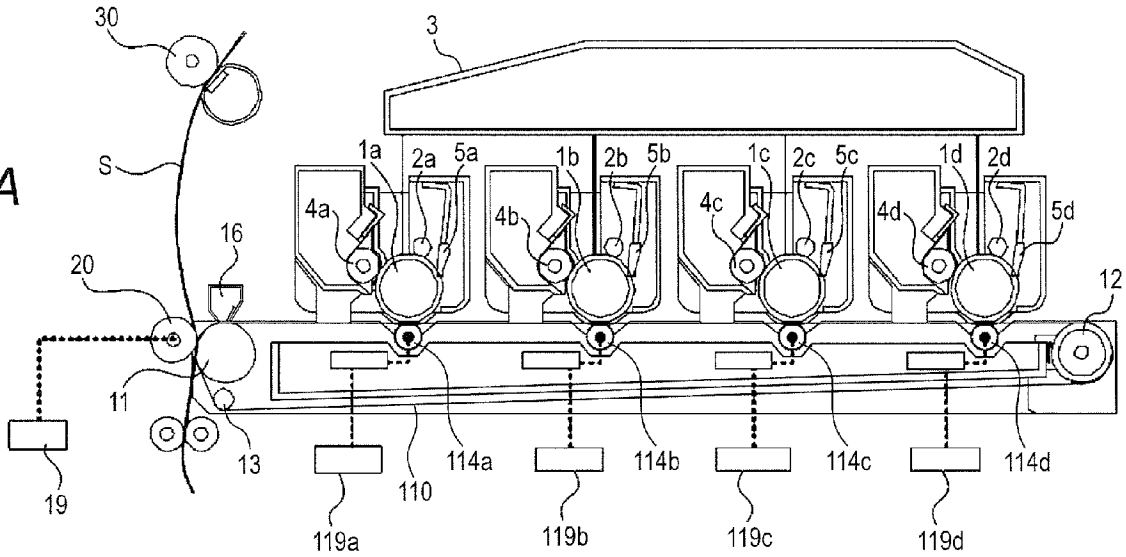
FIG. 9A is a diagram of an image forming apparatus of a comparative example whose number of electric contacts is large.
Figure 9B:
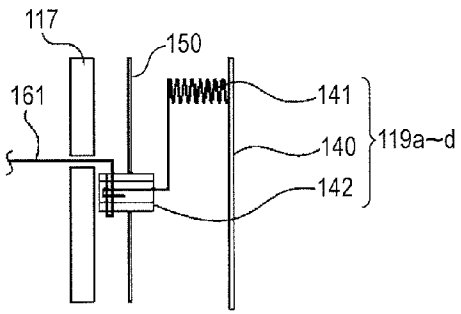
FIG. 9B is an enlarged view of a frame of an intermediate transfer unit of FIG. 9A.

To be compared with this embodiment, an image forming apparatus including a large number of electric contacts is described. FIGS. 9A and 9B are schematic diagrams of the image forming apparatus including the large number of electric contacts. A basic configuration thereof is similar to the image forming apparatus which is described with reference to FIG. 1, and hence, description regarding the same members is omitted.

In the image forming apparatus described with reference to FIG. 9A, primary transfer members 114*a*, 114*b*, 114*c*, and 114*d*, which are connected to power supplies 119*a*, 119*b*, 119*c*, and 119*d* for primary transfer, which are dedicated to the primary transfer, are disposed at the positions opposite to the respective photosensitive drums.

FIG. 9B is an enlarged view for illustrating the electric contacts between the respective voltage power supplies and the intermediate transfer unit. As illustrated in FIG. 9B, at the respective power supplies 119*a*, 119*b*, 119*c*, and 119*d* for primary transfer, the primary transfer voltage output from a high voltage substrate 140 is supplied via a bias spring 141. At this time, in order to prevent the leakage to a main body frame 150 of the image forming apparatus which is formed of a sheet metal, an insulating member 142 is required. The primary transfer voltage supplied via the bias spring 141 can be introduced to the intermediate transfer unit via the insulating member 142. Moreover, a contact spring 161, which is exposed outside the unit through a frame 117 of the intermediate transfer unit, is connected to the primary transfer member of the intermediate transfer unit. This contact spring 161 on the intermediate transfer unit side and the bias spring 141 on the main body side are connected to each other so that the primary transfer voltage is supplied to the primary transfer members 114*a*, 114*b*, 114*c*, and 114*d*.

In this manner, a large number of parts are required for connecting the primary transfer members 114*a*, 114*b*, 114*c*, and 114*d* on the intermediate transfer unit side and the power supplies 119*a*, 119*b*, 119*c*, and 119*d* for primary transfer on the main body side to one another. Moreover, in the configuration in which the intermediate transfer unit is removably mounted to the image forming apparatus main body, additional parts are required, and the apparatus becomes complicated, taking into account mounting/removing trajectories and sure achievement of contacts.

In contrast, by adopting the intermediate transfer unit U of this embodiment, the number of electric contacts between the intermediate transfer unit U and the apparatus main body 100 can be decreased. Thus, the apparatus can be downsized, and the cost can be lowered.

(Second Embodiment)

Next, an image forming apparatus according to a second embodiment of the present invention is described with reference to FIGS. 10A, 10B, 11A, and 11B. Note that, because a basic configuration of the image forming apparatus according to this embodiment is the same as that of the above-mentioned embodiment, members having the same functions as those of the above-mentioned embodiment are denoted with the same reference symbols, and the redundant description is omitted. In the following, a constituent feature of this embodiment is described.

Figure 10A:
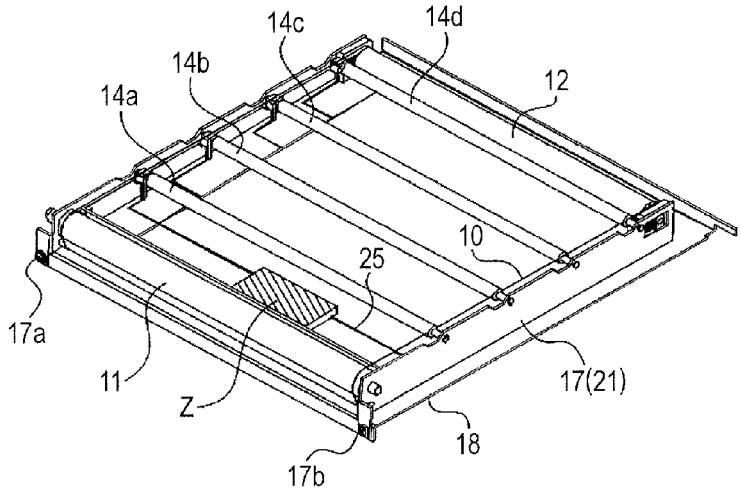
FIG. 10A is a perspective view of an intermediate transfer unit of an image forming apparatus according to a second embodiment of the present invention.
Figure 10B:
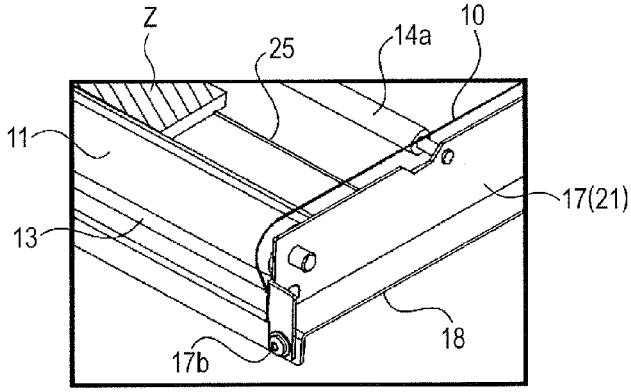
FIG. 10B is an enlarged view of a side surface frame portion of FIG. 10A.
Figure 11A:
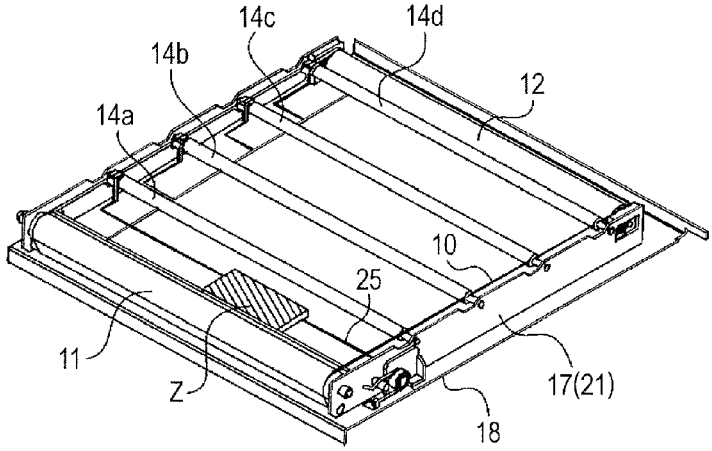
FIG. 11A is a perspective view of the intermediate transfer unit of the image forming apparatus according to the second embodiment.
Figure 11B:
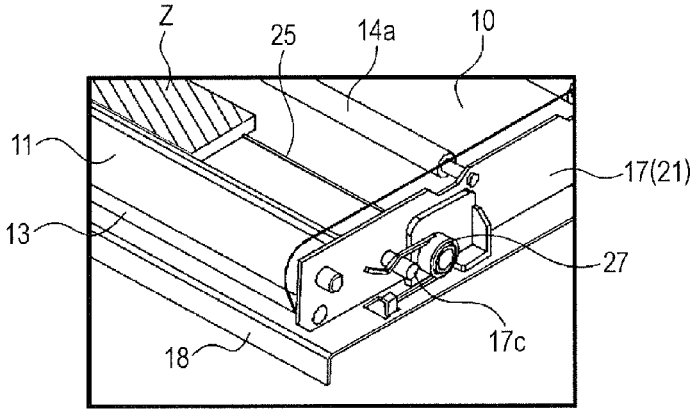
FIG. 11B is an enlarged view of a side surface frame portion of FIG. 11A.

FIGS. 10A and 10B illustrate a screw fixing of the intermediate transfer unit to the image forming apparatus main body. FIGS. 11A and 11B illustrate a press fixing by a spring of the intermediate transfer unit to the image forming apparatus main body. In FIGS. 10A, 10B, 11A, and 11B, for convenience of description, the intermediate transfer belt 10 is illustrated as a transparent member.

Figure 12:
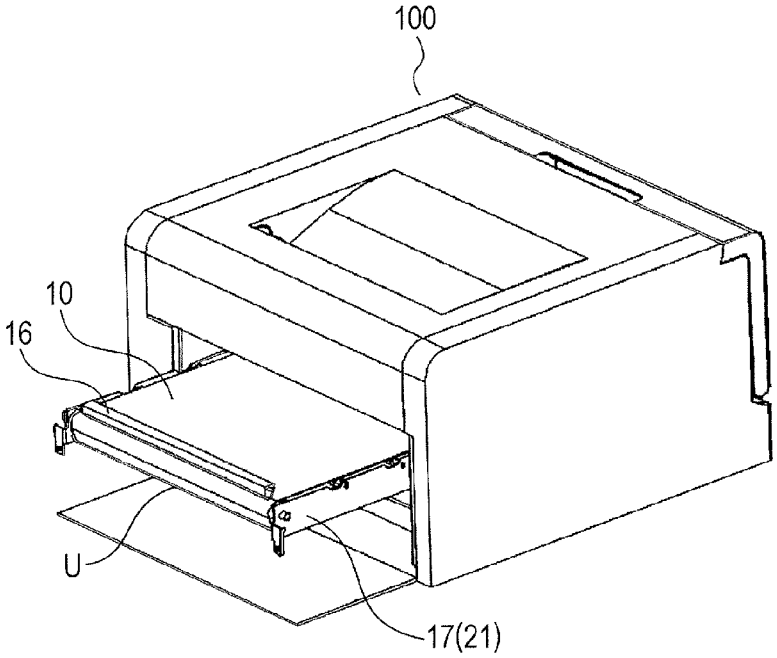
FIG. 12 is a perspective view of the image forming apparatus according to the second embodiment to which the intermediate transfer unit is removably mounted.

Note that, also in this embodiment, as illustrated in FIG. 12, the intermediate transfer belt 10 is integrated as the intermediate transfer unit U together with the drive roller 11, the tension roller 12, and the auxiliary roller 13 which are the multiple tensioning members, and the contact rollers 14*a*, 14*b*, 14*c*, and 14*d* as the contact members. Then, by releasing the screw fixing, the intermediate transfer unit U is removably mounted to the apparatus main body of the image forming apparatus 100.

Moreover, in this embodiment, the side surface frame 17 of the intermediate transfer unit U is a positioning member for positioning the process cartridge including the photosensitive drums 1*a*, 1*b*, 1*c*, and 1*d* to the apparatus main body.

In this embodiment, as illustrated in FIGS. 10A and 10B, the side surface frame 17 of the intermediate transfer unit is formed of a metal sheet, and also functions as the positioning member for the photosensitive drums 1*a*, 1*b*, 1*c*, and 1*d*. With this, it is easy to electrically connect the voltage maintaining element Z to the side surface frame 17 via the contact spring 25.

Moreover, as illustrated in FIGS. 10A and 10B, screw supporting portions 17*a* and 17*b* as fixing members are provided to the side surface frame 17 of the intermediate transfer unit, and the side surface frame 17 is screw-fixed to the main body frame 18 of the image forming apparatus at the screw supporting portions 17*a* and 17*b*. Because a part of the main body frame 18 is connected to the ground portion, the fixing of the intermediate transfer unit with respect to the main body and the ground connection thereof can be simultaneously performed.

Alternatively, as illustrated in FIGS. 11A and 11B, the side surface frame 17 of the intermediate transfer unit is provided with a pressing portion 17*c* as a pressing member which is electrically conductive, and the pressing portion 17*c* is pressed by a press spring 27, which is provided to the image forming apparatus, so as to be fixed. With this, the fixing of the intermediate transfer unit with respect to the main body and the ground connection thereof can be simultaneously performed. In the case where the main body frame 18 is made of conductive material like metal, an area on which the main body frame 18 contacts the side surface frame 17 is the contact area (contact portion).

As described above, according to this embodiment, in addition to the advantageous effects of the above-mentioned embodiment, the following advantageous effect can be further obtained. Namely, the side surface frame 17 of the intermediate transfer unit is formed of a metal sheet, and also functions as the positioning member (side surface frame 21) for positioning the process cartridge including the photosensitive drums to the apparatus main body, and hence, it is easy to simultaneously perform the fixing of the intermediate transfer unit and the ground connection thereof.

(Other Embodiments)

In the above-mentioned embodiments, the configuration in which the contact members are rigid bodies, such as metal rollers, is exemplified, but the contact members are not limited thereto, and non-rotatable type transfer members, which come into contact with the inner surface of the intermediate transfer belt and slide thereon without rotating, may be used.

Moreover, in the above-mentioned embodiments, the configuration including the four image forming portions is exemplified, but the number of the image forming portions to be used is not limited thereto, and can be suitably set as needed.

Figure 13:
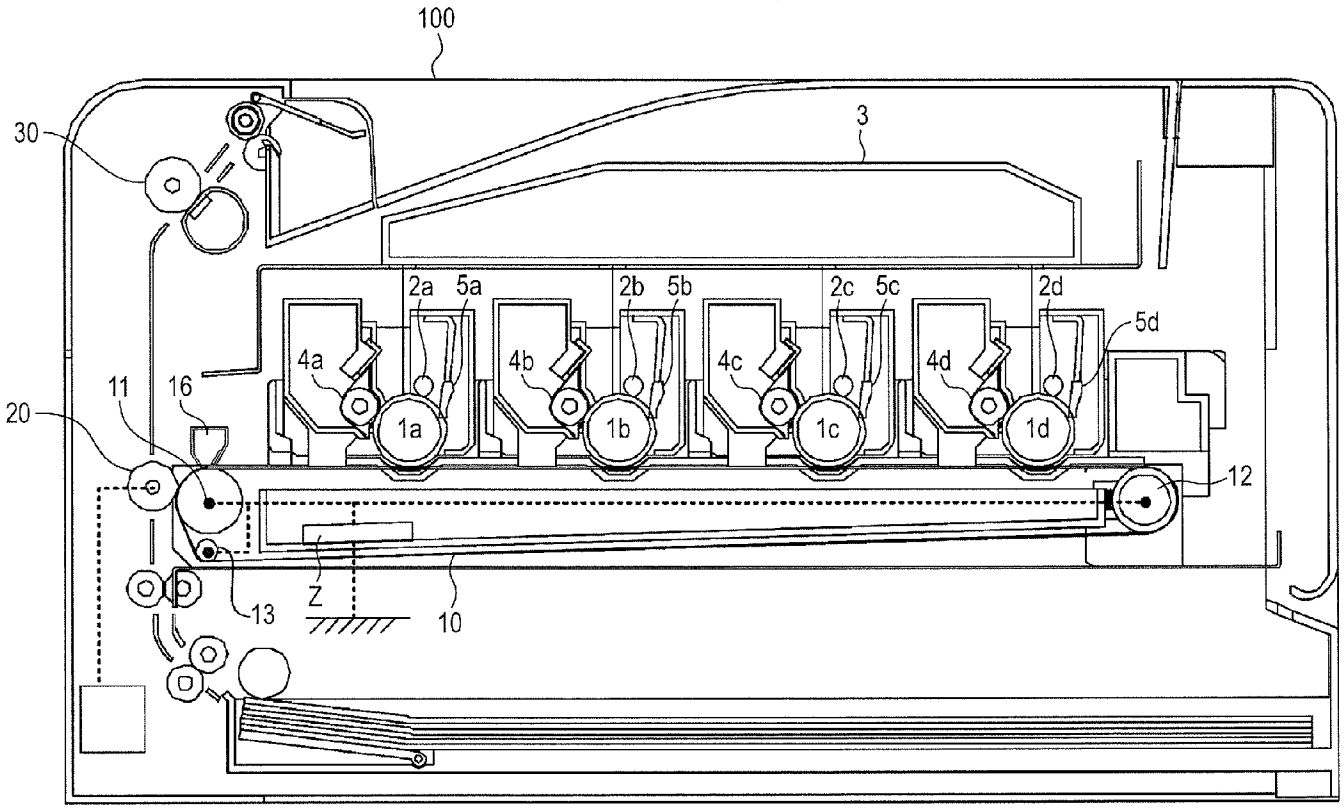
FIG. 13 is a schematic cross-sectional view for illustrating an image forming apparatus according to another embodiment of the present invention.
Figure 14:
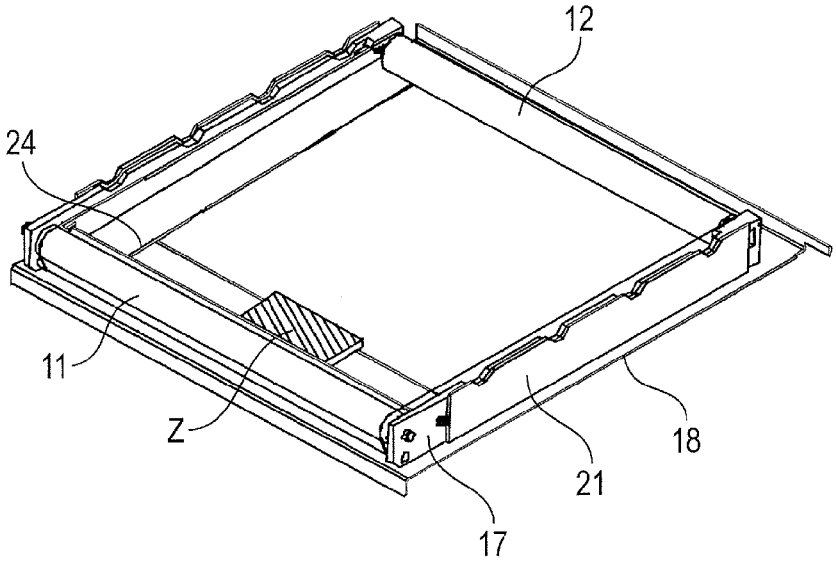
FIG. 14 is a perspective view for illustrating an intermediate transfer unit which is removably mounted to the image forming apparatus according to the another embodiment.

Moreover, the present invention can also be applied to a configuration which is not provided with the contact members as in an image forming apparatus illustrated in FIG. 13. FIG. 14 is a perspective view of the intermediate transfer unit U in the image forming apparatus of FIG. 13. For convenience, the intermediate transfer belt 10 is illustrated as a transparent member. As described with reference to FIG. 14, two tensioning members (drive roller 11 and tension roller 12) which form the primary transfer surface are connected to the Zener diode Z which is the voltage maintaining element. When a configuration is adopted in which the electric conductivity of the intermediate transfer belt 10 is high and a current easily flows in the circumferential direction of the intermediate transfer belt 10, the primary transfer can be performed by the current which is supplied from the secondary transfer roller 20, and the drive roller 11 and the tension roller 12 which are maintained at the Zener voltage.

Also in this case, the contact spring 25*b*, which is electrically connected to the Zener diode Z, comes into contact with the frame 21 which is connected to the ground portion, and hence, the Zener diode Z can be grounded. Accordingly, the single contact spring 25*b* is the only electric contact portion, and hence the number of the electric contacts can be decreased.

In this embodiment, in order to stabilize the intermediate transfer belt potential, the Zener diode Z, which is a constant voltage element, is used as the voltage maintaining element, but another constant voltage element (for example, a varistor) may be used as long as a similar advantageous effect can be obtained by the element. Moreover, a resistive element may be used as long as the voltage can be maintained at a predetermined voltage or higher. For example, a resistive element of 100 MΩ may be used. When using a resistive element, unlike the constant voltage element, the potential fluctuates depending on the amount of current which flows in the resistive element, and hence, the control of the potential becomes more difficult than that of the constant voltage element.

Figure 15:
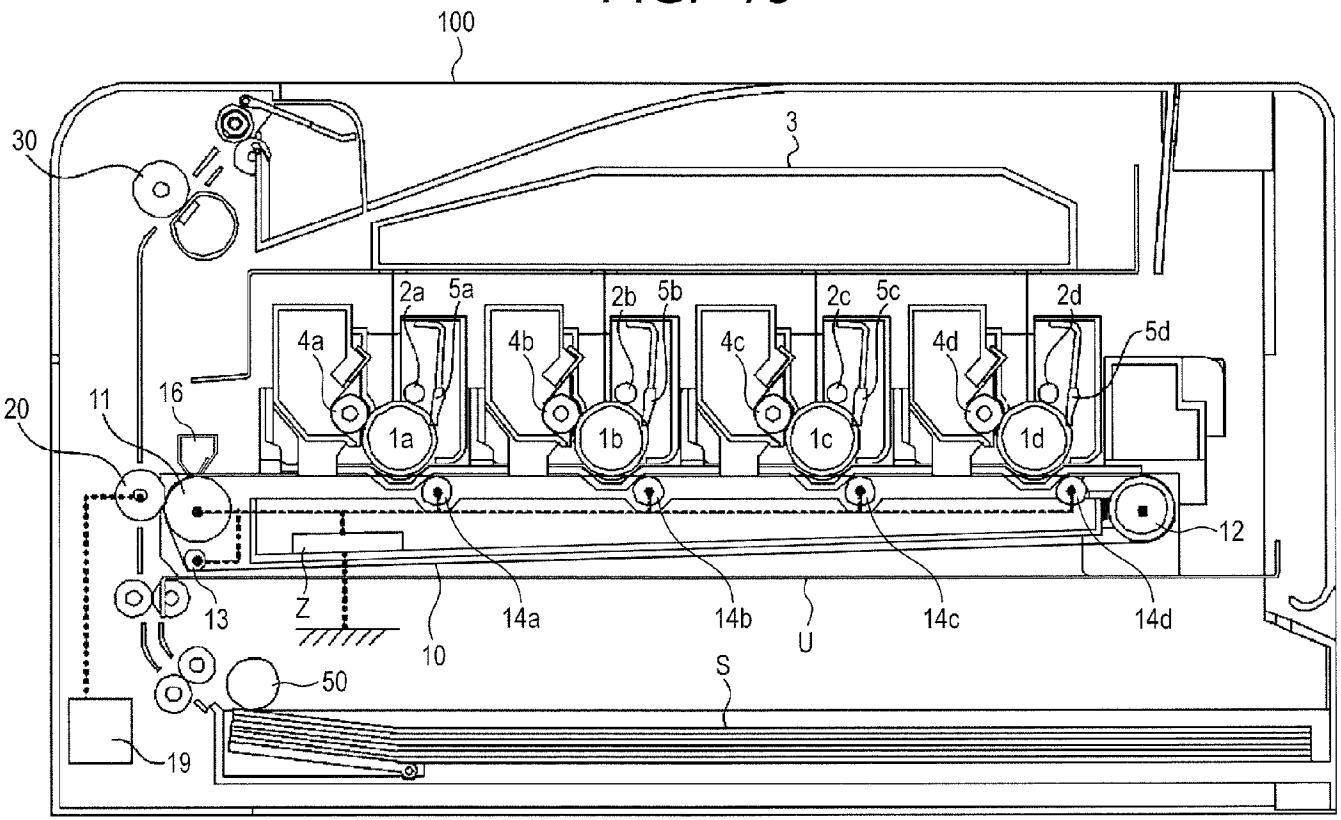
FIG. 15 is a schematic cross-sectional view for illustrating an image forming apparatus according to still another embodiment of the present invention.

Moreover, the image forming apparatus of the first embodiment has the configuration in which the Zener diode Z can be connected to also the tension roller 12, but, as described with reference to FIG. 15, the Zener diode need not be connected to the tension roller 12.

Moreover, in the above-mentioned embodiments, as a process cartridge which is removably mounted to the image forming apparatus, the process cartridge integrally including the photosensitive drums, and the charging device, the developing device, and the cleaning device, as the process units acting on the drums, is exemplified. However, the process cartridge is not limited thereto. For example, the process cartridge may integrally include, in addition to the photosensitive drums, any one of the charging device, the developing device, and the cleaning device.

Moreover, in the above-mentioned embodiment, the configuration in which the intermediate transfer unit, which is removably mounted to the image forming apparatus, is screw-fixed to the apparatus main body, or press-fixed by a spring, is exemplified to be described, but this is not the only case. Another configuration may be used as long as an intermediate transfer unit removably mounted to the image forming apparatus is connected to the apparatus main body so as to be grounded.

Further, in the above-mentioned embodiments, the configuration in which the process cartridge including the photosensitive drums is removably mounted to the image forming apparatus main body is exemplified, but this is not the only case. For example, the image forming apparatus may have a configuration in which respective components, such as the photosensitive drums, are each incorporated into the apparatus main body, or a configuration in which respective components are each removably mounted to the apparatus main body.

Moreover, in the above-mentioned embodiments, the printer is exemplified as the image forming apparatus, but the present invention is not limited thereto. For example, the image forming apparatus may be a copying machine, a facsimile machine, etc., or a multifunctional peripheral in which functions thereof are combined. As long as the image forming apparatus includes the intermediate transfer unit removably mounted to the image forming apparatus as described above, similar advantageous effects can be obtained by applying the present invention to these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-085306, filed Apr. 4, 2012, which is hereby incorporated by reference herein in its entirety.

What is claimed is:

1. An image forming apparatus, comprising:

an apparatus main body;

an image bearing member which is capable of bearing a toner image;

a current supply member; and an intermediate transfer unit which is removably mounted to the apparatus main body, wherein the intermediate transfer unit includes:

an endless belt, in a condition where the intermediate transfer unit is attached to the apparatus main body, whose outer peripheral surface is configured to contact the current supply member, onto which the toner image is transferred from the image bearing member by current supplied from the current supply member;

a contact member, in a condition where the intermediate transfer unit is attached to the apparatus main body, configured to contact an inner peripheral surface of the endless belt at a position opposed to the image bearing member through the endless belt;

an opposing member, in a condition where the intermediate transfer unit is attached to the apparatus main body, configured to contact the inner peripheral surface of the endless belt at a position opposed to the current supply member through the endless belt; and a voltage maintaining element which is connected to the opposing member and the contact member.

2. An image forming apparatus according to claim 1, wherein the voltage maintaining element maintains each of potentials of the opposing member and the contact member at a level equal to or more than a predetermined level by a current flowing from the current supply member to the opposing member through the intermediate transfer belt.

3. An image forming apparatus according to claim 1, wherein the voltage maintaining element includes a constant voltage element.

4. An image forming apparatus according to claim 1, wherein the intermediate transfer unit further comprises multiple stretching members which stretch the endless belt, the contact member is disposed between the stretching members, and one of the stretching members also functions as the opposing member.

5. An image forming apparatus according to claim 4, further comprising:

a transfer power supply which applies a voltage to the current supply member, wherein the current supply member forms a secondary transfer portion with the endless belt to secondarily transfer the toner image on the endless belt onto a recording material and supplies current to the endless belt at the secondary transfer portion by applying the voltage from the transfer power supply.

6. An image forming apparatus according to claim 1, further comprising a main body frame connected to a ground portion which is grounded, wherein the intermediate transfer unit further comprises a contact portion which comes into contact with the main body frame.

7. An image forming apparatus according to claim 6, wherein the contact portion and the voltage maintaining element are electrically connected to each other.

8. An image forming apparatus according to claim 7, wherein the intermediate transfer unit comprises only a single contact portion.

9. An image forming apparatus according to claim 8, wherein the voltage maintaining element is a Zener diode.

10. An image forming apparatus according to claim 9, wherein the Zener diode is connected on a cathode side thereof to the contact member and the opposing member, and on an anode side thereof to the contact portion.

11. An image forming apparatus according to claim 6, wherein the contact portion includes a contact spring.

12. An image forming apparatus according to claim 1, wherein the image forming apparatus further includes one or more image bearing members, wherein the image bearing members bear toner images of different colors, respectively.

13. An image forming apparatus according to claim 12, wherein the intermediate transfer unit further includes one or more contact members, wherein the contact members are disposed so that each of the contact members corresponds to each of the image bearing members.

14. An image forming apparatus according to claim 1, wherein the image bearing member is removably mounted to the apparatus main body as a process cartridge, and the intermediate transfer unit further includes a positioning member for positioning the process cartridge.

15. An image forming apparatus according to claim 1, wherein the apparatus main body includes a supporting portion which is connected to a ground portion, and wherein the intermediate transfer unit further comprises a contact portion which comes into contact with the supporting portion, the contact portion is electrically connected to the voltage maintaining element, and when the contact portion is fixed to the supporting portion, the intermediate transfer unit is fixed to the apparatus main body and is connected to a ground, simultaneously.

16. An image forming apparatus according to claim 1, wherein the contact member opposes the image bearing member at a portion shifted from a position in which the image bearing member contacts the endless belt in a direction in which the endless belt rotates.

17. An image forming apparatus according to claim 1, wherein the opposing member pinches the endless belt with the current supply member.

18. An image forming apparatus according to claim 1, wherein the image bearing member is provided in a cartridge that is removably attachable to the apparatus main body.

19. An intermediate transfer unit removably attachable to an image forming apparatus having a current supply member and an image bearing member capable of bearing a toner image, comprising:

an endless belt, in a condition where the intermediate transfer unit is attached to the apparatus main body, whose outer peripheral surface is configured to contact the current supply member, onto which the toner image is transferred from the image bearing member by current supplied from the current supply member;

a contact member, in a condition where the intermediate transfer unit is attached to the image forming apparatus, configured to contact an inner peripheral surface of the endless belt at a position opposed to the image bearing member through the endless belt;

an opposing member, in a condition where the intermediate transfer unit is attached to the image forming apparatus, configured to contact the inner peripheral surface of the endless belt at a position opposed to the current supply member through the endless belt; and a voltage maintaining element which is connected to the opposing member and the contact member.

20. An intermediate transfer unit according to claim 19, wherein the voltage maintaining element maintains each of potentials of the opposing member and the contact member at a level equal to or more than a predetermined level by a current flowing from the current supply member to the opposing member through the intermediate transfer belt.

21. An intermediate transfer unit according to claim 19, wherein the voltage maintaining element includes a constant voltage element.

22. An intermediate transfer unit according to claim 19, wherein the intermediate transfer unit further comprises multiple stretching members which stretch the endless belt, the contact member is disposed between the stretching members, and one of the stretching members also functions as the opposing member.

23. An intermediate transfer unit according to claim 21, wherein the voltage maintaining element is a Zener diode.

24. An intermediate transfer unit according to claim 21, wherein the contact member opposes the image bearing member at a portion shifted from a position in which the image bearing member contacts the endless belt in a direction in which the endless belt rotates.

25. An intermediate transfer unit according to claim 21, wherein the opposing member pinches the endless belt with the current supply member.

* * * * *